United States Patent [19]

Narasimhan

[11] 4,285,386

[45] * Aug. 25, 1981

[54] CONTINUOUS CASTING METHOD AND APPARATUS FOR MAKING DEFINED SHAPES OF THIN SHEET

[75] Inventor: Mandayam C. Narasimhan, Seekonk, Mass.

[73] Assignee: Allied Chemical Corporation, Morris Township, Morris County, N.J.

[ * ] Notice: The portion of the term of this patent subsequent to Feb. 27, 1996, has been disclaimed.

[21] Appl. No.: 20,906

[22] Filed: Mar. 16, 1979

[51] Int. Cl.[3] ..... B22D 11/06; B22D 25/00

[52] U.S. Cl. ..... 164/463; 164/423; 164/429; 164/474

[58] Field of Search ..... 164/64, 87, 423, 429, 164/88

[56] References Cited

U.S. PATENT DOCUMENTS

| | | | |
|---|---|---|---|
| 2,210,145 | 8/1940 | De Bats | 164/429 X |
| 2,664,605 | 1/1954 | Beste | 164/429 X |
| 3,587,717 | 6/1971 | Yamauchi et al. | 164/88 X |
| 3,896,203 | 7/1975 | Maringer et al. | 164/87 X |
| 4,142,571 | 3/1979 | Narasimhan | 164/429 X |
| 4,155,397 | 5/1979 | Honsinger et al. | 164/423 X |
| 4,212,343 | 7/1980 | Narasimhan | 164/429 X |

FOREIGN PATENT DOCUMENTS

| | | | |
|---|---|---|---|
| 46-26626 | 8/1971 | Japan | 164/88 |

*Primary Examiner*—Robert D. Baldwin

*Attorney, Agent, or Firm*—Gerhard H. Fuchs; Ernest D. Buff

[57] ABSTRACT

Defined shapes of thin metallic sheet are continuously formed by forcing molten metal onto the surface of a moving chill body under pressure through a slotted nozzle located in close proximity to the surface of the chill body. The surface of the chill body whereon the shaped parts are formed is provided with raised or lowered domains corresponding in outline to that of the desired defined shape. As the metal is cast, as a thin sheet against the chill surface, discontinuities arise in the sheet at the walls of the raised or lowered domains defining the desired shape so that sheet product of defined shape is obtained, as if punched out from a continuous strip of the metal.

15 Claims, 4 Drawing Figures

FIG. 1
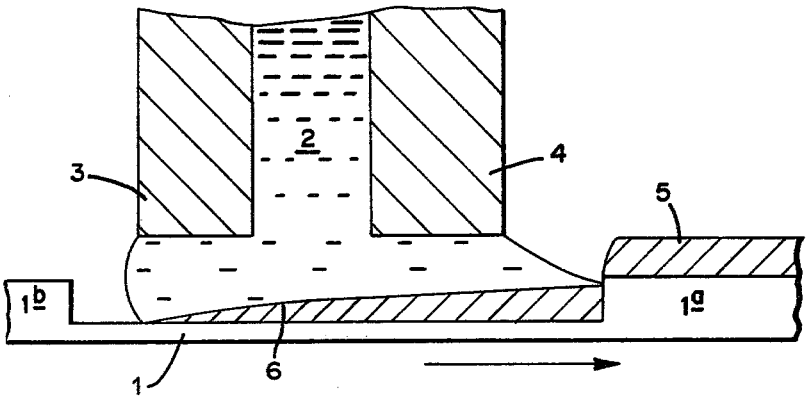
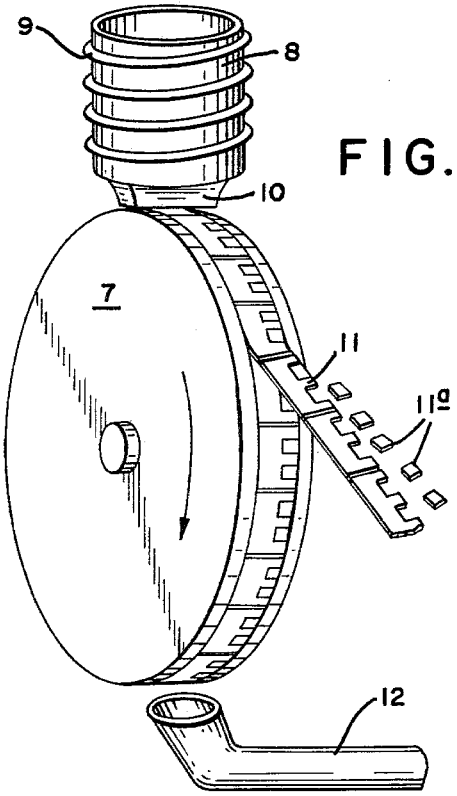
FIG. 2

CONTINUOUS CASTING METHOD AND APPARATUS FOR MAKING DEFINED SHAPES OF THIN SHEET

BACKGROUND OF THE INVENTION

This invention relates to a method and apparatus for continuous production of essentially flat, shaped parts of thin metallic sheet, particularly those with glassy (amorphous) molecular structure, by depositing molten metal onto the moving surface of a chill body provided with raised or lowered domains corresponding in outline to that of the desired shaped parts by forcing the metal through a slotted nozzle located in close proximity to the surface of the chill body.

The process and apparatus of the present invention are similar to those disclosed in U.S. Pat. No. 4,142,571. These, however, employ a chill body having an essentially flat chill surface, and consequently produce an essentially flat strip product. Pertinent portions of the disclosure of U.S. Pat. No. 4,142,571 are hereby incorporated by reference.

SUMMARY OF THE INVENTION

In accordance with the present invention, it has been found that, if a thin uniform layer of molten material is mechanically supported on a chill surface having lowered and/or raised flat domains by the method and apparatus of my invention, it becomes possible to continuously draw out thin essentially flat metal sheets having an outline corresponding to that of the domains.

Accordingly, the present invention provides an apparatus for making essentially flat metal sheets having a defined outline directly from the melt. It comprises a movable chill body provided with raised and/or lowered domains in the outline of the desired shape of the metal sheet product, a slotted nozzle in communication with a reservoir for holding molten metal, and means for effecting expulsion of the molten metal from the reservoir through the nozzle onto the moving chill surface.

The movable chill body provides a chill surface for deposition thereon of molten metal for solidification. The chill body is adapted to provide longitudinal movement of the chill surface at velocities in the range of from about 100 to about 2000 meters per minute. The chill surface is provided with essentially flat raised and/or lowered domains. These domains are in the outline of the desired shaped metal sheet products. The domains are bordered by a wall, which is at least about as high as the thickness of the cast shaped metal sheet product. Desirably, the domain walls are at least about twice as high as the thickness of the sheet product. The domain walls are formed at an angle deviating not more than about 20° from the normal to the chill surface. Desirably, the walls are essentially perpendicular to the chill surface. There are no limits to the form of the domain boundaries, hence, no limits to the shapes of the sheet products which can be made by my process.

The reservoir for holding molten metal includes heating means for maintaining the temperature of the metal above its melting point. The reservoir is in communication with the slotted nozzle for depositing molten metal onto the chill surface.

The slotted nozzle is located in close proximity to the chill surface. Its slot is arranged perpendicular to the direction of movement of the chill surface. The slot is defined by a pair of generally parallel lips, a first lip and a second lip, numbered in direction of movement of the chill surface. The slot must have a width, measured in direction of movement of the chill surface, of from about 0.3 to about 1 millimeter. There is no limitation on the length of the slot (measured perpendicular to the direction of movement of the chill surface) other than the practical consideration that the slot should not be longer than the width of the chill surface. The slot, of course should be wide enough to cover the domains on the chill surface which are moved past it.

The width of the lips, measured in direction of movement of the chill surface, is a critical parameter. The first lip has a width at least equal to the width of the slot. The second lip has a width of from about 1.5 to about 3 times the width of the slot. The gap between the lips and the domain surface is at least about 0.1 times the width of the slot, but may be large enough to equal the width of the slot.

Means for effecting expulsion of the molten metal contained in the reservoir through the nozzle for deposition onto the moving chill surface include pressurization of the reservoir, such as by an inert gas, or utilization of the hydrostatic head of molten metal if the level of metal in the reservoir is located in sufficiently elevated position.

The invention further provides a continuous method for forming essentially flat, thin metal sheets of predetermined outline by depositing molten metal onto the surface of a moving chill body having raised and/or lowered domains in the outline of the desired sheet product, which involves moving the surface of a chill body in a longitudinal direction at a constant, predetermined velocity within the range of from about 100 to about 2000 meters per minute past the orifice of a slotted nozzle defined by a pair of generally parallel lips located proximate to said surface such that the gap between the lips and the domain surface is from between about 0.03 to about 1 millimeter, and forcing a stream of molten metal through the orifice of the nozzle into contact with the surface of the moving chill body covering the domain, as well as the remaining portions of the chill surface, to permit the metal to solidify thereon to form the desired shaped sheet product. The desired sheet product is formed on the surface of the domains. The solidified sheet metal formed on the chill surface on portions other than those represented by the domains represents scrap. The desired sheet product thus is formed as if it were punched from a strip. Due to critical selection of heights of the boundary walls (i.e. at least about as high as the thickness of the cast shaped sheet product), and the angle which these walls form with respect to the chill body surface (i.e., essentially perpendicular to the chill body surface) a sharp, well-defined separation of the molten metal deposited on the chill surface occurs along these boundaries, resulting in formation of the shaped sheet product. The orifice of the slotted nozzle is being arranged generally perpendicular to the direction of movement of the surface of the chill body. Desirably, the molten metal is an alloy which, upon cooling from the melt and quenching at a rate of at least about $10^{4}$° C./sec. forms an amorphous solid; it may also form a polycrystalline metal.

At the domain wall (sometimes also referred to as the "bordering wall") the molten metal being forced through the nozzle is incapable of conforming to the surface contour of the chill surface and a discontinuity develops in the cast sheet. In order to produce such discontinuity, the domain walls must be at least as high as the cast sheet is thick, desirably at least about twice as high. Furthermore, the walls must be steep. The required degree of steepness is to some extent dependent upon the direction of the wall with respect to its relation to the nozzle arrangement, and the direction of movement of the chill surface, since the slot in the nozzle is arranged generally perpendicular to the direction of movement of the chill surface. Walls which are parallel to the slot formed by the nozzle (i.e., transverse to the direction of movement of the chill surface) need not be as steep as those which are perpendicular to the slot direction (i.e., those which extend in the direction of movement of the chill surface). The former need not be perpendicular to the chill surface (although they desirably are perpendicular) and they may deviate as much as about 25°, more usually about 20° from the normal to the chill surface. The latter desirably are perpendicular to the chill surface. Walls running in a direction between these extremes may have an angle between, say, 20° and 90° (perpendicular); those running in a direction close to the direction of movement of the chill surface requiring an angle closer to the perpendicular, whereas those running more nearly transverse to the direction of movement of the chill surface may have an angle approaching, say 20°. Since, however, cast shaped sheets can be separated at the replicated boundary walls in the event there is no complete discontinuity, and since in many instances it is desirable to have such incomplete separation and to effect separation in a subsequent operation, it may oftentimes be desirable to employ domain walls deviating up to, say, 20° from the normal. In the event the domains are raised, it is of course also possible to undercut the domain walls, in which event complete separation of the sheet product from scrap is assured.

The apparatus and method of my invention are eminently suited for extremely rapid large volume productions of identically shaped sheet products such as sheets for stacking into magnetic cores, such as used for electric motors, transformers, and the like.

BRIEF DESCRIPTION OF THE DRAWINGS

FIG. 1 of the drawings provides a side view in partial cross section illustrating formation of shaped sheet product from molten metal deposited onto a moving chill surface having a defined domain from a nozzle having specific configuration and placement with relation to the chill surface, in accordance with the present invention.

FIGS. 2 and 3 of the drawings each provide a somewhat simplified perspective view of two embodiments of apparatus of the present invention in operation. In FIG. 2, casting takes place on the surface of a chill roll mounted to rotate around its longitudinal axis. In FIG. 3, casting takes place on the surface of an endless moving belt.

DETAILED DESCRIPTION OF THE INVENTION AND THE PREFERRED EMBODIMENTS

Figure 3:
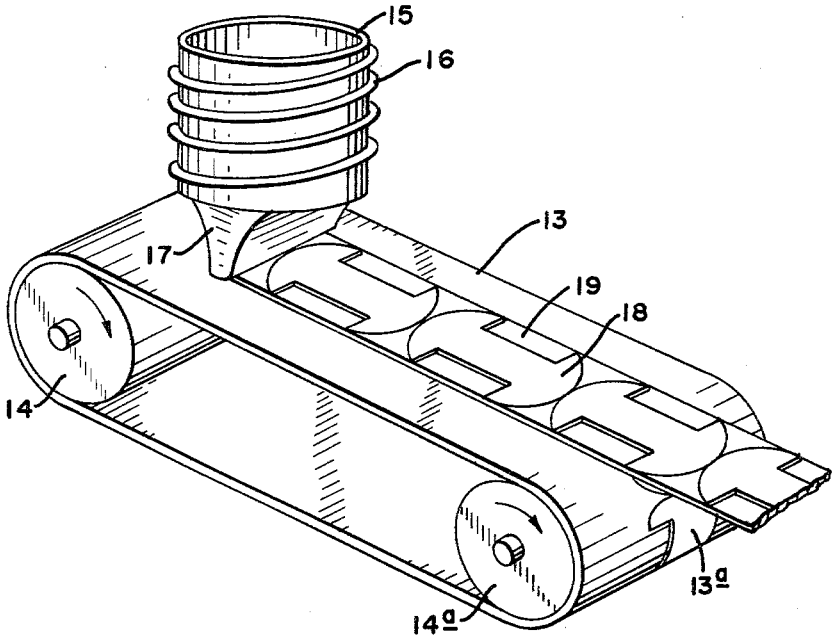

With reference to the drawings, FIG. 1 shows in partial cross-section a side view illustrating the method of the present invention. As shown in FIG. 1, a chill body 1, here illustrated as a belt, having raised domains 1*a* and 1*b* travels in the direction of the arrow in close proximity to a slotted nozzle defined by a first lip 3 and a second lip 4. Molten metal 2 is forced under pressure through the nozzle to be brought into contact with the total surface of the moving chill body, the domain surface as well as the remaining surface. As the metal is solidified in contact with the surface of the moving chill body, a solidification front, indicated by line 6, is formed. Above the solidification front a body of molten metal is maintained. The solidification front misses the end of second lip 4. First lip 3 supports the molten metal essentially by the pumping action of the melt which results from constant removal of solidified metal 5. The surface of the moving chill body 1 travels at a velocity within the range of from about 100 to about 2000 meters per minute. The rate of flow of molten metal equals the rate of removal of the solidified metal and is self-controlled. The rate of flow is pressure assisted, but controlled by the forming solidification front and the second lip 4 which mechanically supports the molten metal below it. Thus, the rate of flow of the molten metal is primarily controlled by the viscous flow between the second lip and the solidified metal and is not primarily controlled by the slot width. In order to obtain a sufficiently high quench rate to make a glassy (amorphous) sheet product, the surface of the chill body must ordinarily move at a velocity of at least about 200 meters per minute. At lower velocities it is general not possible to obtain quench rates, that is to say cooling rates at the solidification temperature, of at least $10^{4}$° C. per second, as is required in order to obtain glassy metal product. Of course, lower velocities, as low as about 100 meters per minute, are usually operable, but result in polycrystalline product. And, in any event, casting by my process of metal alloys which do not form amorphous solids will result inpolycrystalline products, regardless of the velocity of travel of the chill surface. The velocity of movement of the chill surface should not be in excess of about 2000 meters per minute because as the speed of the substrate increases, the height of the solidification front is despressed due to decreased time available for solidification. This leads to formation of thin sheet (thickness less than about 0.02 millimeter). Since the success of my process hinges on thorough wetting of the chill substrate by the molten metal, and since very thin layers of molten metal (e.g. thinner than about 0.02 millimeter) do not adequately wet the chill substrate, thin, porous sheet is obtained which is not commercially acceptable. This is particularly pronounced if the casting operation is carried out other than in vacuum, since currents of the ambient gas, such as air, have substantial adverse influence on sheet formation at higher substrate speeds. As a general proposition, it can be stated that an increase in chill surface velocity results in production of thinner sheet and, conversely, that a reduction of that velocity results in thicker sheet. Preferably, velocities range from about 300 to about 1500, more preferably from about 600 to about 1000 meters per minute.

Figure 4:
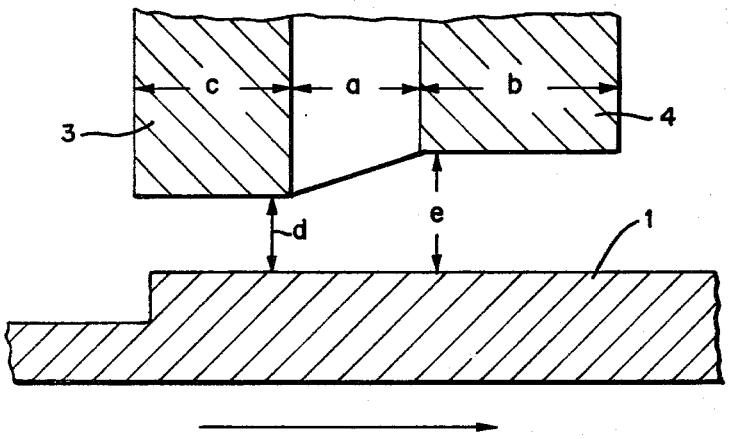
FIG. 4 provides a side view in cross section of a nozzle in its relation to the domain surface of the chill substrate for discussion of relative dimensions of slot width, lip dimensions, and gap between lip and chill surface.

Certain dimensions concerning the nozzle and its interrelationship with the chill surface are critical. They are explained with reference to FIG. 4 of the drawings. With reference to FIG. 4, width a of the slot of the slotted nozzle, which slot is arranged perpendicular to the direction of movement of the chill surface, should be from about 0.3 to about 1 millimeter, preferably from about 0.6 to about 0.9 millimeter. As previously stated, the width of the slot does not control the rate of flow of molten metal therethrough, but it might become a limiting factor if it is too narrow. While, to some extent that may be compensated for by employing higher pressures to force the molten metal at the required rate through the narrower slot, it is more convenient to provide a slot of sufficient width. If, on the other hand, the slot is too wide, say wider than about 1 millimeter, then at any given velocity of movement of the chill surface, the solidification front formed by the metal as it solidifies on the chill surface will be correspondingly thicker, resulting in a thicker sheet which could not be cooled at a rate sufficient to obtain glassy sheet, if this were desired.

With further reference to FIG. 4, width b of second lip 4 is about 1.5 to about 3 times the width of the slot, preferably from about 2 to about 2.5 times the width of the slot. Optimum width can be determined by simple routine experimentation. If the second lip is too narrow, then it will fail to provide adequate support to the molten metal and only discontinuous sheets are produced. If, on the other hand, the second lip is too wide, solid-to-solid rubbing between the lip and the sheet may result, leading to rapid failure of the nozzle. With further reference to FIG. 4, width c of first lip 3 must be at least about equal to the width of the slot, preferably at least about 1.5 times the width of the slot. If the first lip is too narrow, then the molten metal will tend to ooze out, the molten metal will not uniformly wet the chill surface, and no sheet, or only irregular sheet will be formed. Preferred dimensions of the first lip are from about 1.5 to about 3, more preferably from about 2 to about 2.5 times the width of the slot.

Still with reference to FIG. 4, the gap between the domain surface on the chill body 1 and first and second lips 3 and 4, respectively represented by d and e, may be from about 0.03 to about 1 millimeter, preferably from about 0.03 to about 0.25 millimeter, more preferably yet from about 0.08 to about 0.15 millimeter. In the event the domains are formed as lowered portions on the chill surface, then, in no event may the gap between the remaining surface of the chill body and the lips be less than about 0.03 millimeter. A gap in excess of about 1 millimeter would cause flow of the molten metal to be limited by slot width rather than by the lips. Sheets produced under this condition are thicker, but are of non-uniform thickness. Moreover, they usually are insufficiently quenched and consequently have non-uniform properties. Such product lacks commercial acceptability. On the other hand, a gap of less than about 0.03 millimeter would lead to solid-to-solid contact between the solidification front and the nozzle when the slot width is in excess of about 0.3 millimeter, leading to rapid failure of the nozzle. Within the above parameters, the gap between the domain surface of the chill body and the lips may vary. It may for example, be larger on one side than the other, so that a sheet of varying thickness across its width is obtained.

Within the above parameters, when, for example, the chill surface may be moved at a velocity of about 700 meters per minute, the width of the slot may be between about 0.5 to 0.8 millimeter. The second lip should be between about 1.5 to 2 times the width of the slot, and the first lip should be about 1 to 1.5 times the width of the slot. The metal in the reservoir should be pressurized to between about 0.5 to 2 psig. The gap between the second lip and the domain surface may be between about 0.05 to 0.2 millimeter.

With reference to FIG. 2 of the drawings, which provides a perspective view of apparatus for carrying out the method of the present invention, there is shown an annular chill roll 7 rotatably mounted around its longitudinal axis, having a chill surface provided with a plurality of domains in the shape of E-sections, for making E-shaped sheets for stacking into a transformer core, and reservoir 8 for holding molten metal equipped with induction heating coils 9. Reservoir 8 is in communication with slotted nozzle 10, which, as above described, is mounted in close proximity to the surface of annular chill roll 7. Annular chill roll 7 may optionally be provided with cooling means (not shown), as means for circulating a cooling liquid, such as water, through its interior. Reservoir 8 is further equipped with means (not shown) for pressurizing the molten metal contained therein to effect expulsion thereof through nozzle 10. In operation, molten metal maintained under pressure in reservoir 8 is ejected through nozzle 10 onto the surface of the rotating chill roll 1, whereon it immediately solidifies to form E-shaped sheet product 11, and scrap 11*a*. Sheet product 11 and scrap 11*a* are separated from the chill roll by means of a blast of air from nozzle 12 and are flung away therefrom to be collected by a suitable collection device (not shown).

The embodiment illustrated by FIG. 3 of the drawing employs as chill body an endless belt 13 which is placed over rolls 14 and 14*a* which are caused to rotate by external means (not shown). The chill surface of the belt is provided with domains 13*a* in the form of sheet shaped for stacking to form the magnetic core for the rotor of a small electric motor. Molten metal is provided from reservoir 15, equipped with means for pressurizing the molten metal therein (not shown). Molten metal in reservoir 15 is heated by electrical induction heating coil 16. Reservoir 15 is in communication with nozzle 17 equipped with a slotted orifice. In operation, belt 13 is moved at a longitudinal velocity of at least about 600 meters per minute. Molten metal from reservoir 15 is pressurized to force it through nozzle 17 into contact with belt 13, whereon it is solidified into the desired shaped sheet sections 18 and scrap 19, which are separated from belt 13 by means not shown.

The surface of the chill body which provides the actual chill surface can be any metal having relatively high thermal conductivity, such as copper. This requirement is particularly applicable if it is desired to make glassy or metastable metal sheet product. Preferred materials of construction include beryllium-copper and oxygen free copper. If desired, the chill surface may be highly polished or may be provided with a highly uniform surface, such as chrome plate, to obtain sheet product having smooth surface characteristics. The domain walls have a height of at least about the thickness of the sheet product, desirably of from about 1 to 5 times the thickness of the sheet product, preferably of from about 2 to 4 times the thickness of the sheet product. In order to prevent separation of the shaped product from the scrap during the casting operation, the domain walls may be provided with short sections having lesser heights, or having less steep walls, so that of these sections separation of the shapes from the scrap is incomplete, and the shapes can be separated from the scrap in a subsequent operation, as by running the strip comprising shapes and scrap through a pair of rollers biased against each other to effect breakage of the sheet at the points of incomplete separation, to separate the shaped product from the scrap. The scrap may be recycled to the casting operation.

In short run operation it will not ordinarily be necessary to provide cooling for the chill body, provided it has relatively large mass so that it can act as a heat sink and absorb considerable amount or heat. However, for longer runs, and especially if the chill body is a belt which has relatively little mass, cooling of the chill body is desirably provided. This may be conveniently accomplished by contacting it with cooling media which may be liquids or gases. If the chill body is a chill roll, water or other liquid cooling media may be circulated through it, or air or other gases may be blown over it. Alternatively, evaporative cooling may be employed, as by externally contacting the chill body with water or any other liquid medium which through evaporation provides cooling, including wet steam, especially if the operation is conducted under reduced pressure.

The slotted nozzle employed for depositing molten metal onto the chill surface may be constructed of any suitable material. Desirably, a material is chosen which is not wetted by the molten metal. A convenient material of construction is fused silica, which may be blown into desired shape and then be provided with a slotted orifice by machining. For the sake of convenience, the reservoir and the nozzle may be shaped from a single piece of material.

The molten metal which is to be formed into a shaped sheet product, by means of the method of the present invention is heated, preferably in an inert atmosphere, to temperature approximately 50° to 100° C. above its melting point or higher. A slight vacuum may be applied to the vessel holding the molten metal to prevent premature flow of the molten metal through the nozzle. Ejection of the molten metal through the nozzle is required and may be effected by the pressure of the static head of the molten metal in the reservoir, or preferably by pressurizing the reservoir to pressure in the order of, say, 0.5 to 1 psig, or until the molten metal is ejected. If pressures are excessive, more molten metal may be forced through the slot than can be carried away by the chill surface resulting in uncontrolled pressure flow. In a severe case, splattering of the molten metal may result.

Metals which can be formed into polycrystalline strip directly from the melt by my process include aluminum, tin, copper, iron, steel, stainless steel and the like.

Metal alloys which, upon rapid cooling from the melt, form solid amorphous structures are preferred. These are well known to those skilled in the art. Exemplary such alloys are disclosed in U.S. Pat. Nos. 3,427,154 and 3,981,722, as well as others.

The process of the present invention may be carried out in air, in a partial or high vacuum, or in any desired atmosphere which may be provided by an inert gas such as nitrogen, argon, helium, and the like. When it is conducted in vacuum, it is desirably conducted under vacuum within the range of from about 100 up to about 3000 microns.

The following example illustrates the present invention and sets forth the best mode presently contemplated for its practice.

EXAMPLE

Apparatus employed is similar to that depicted in FIG. 2. The chill roll employed has a diameter of 16 inches and it is 5 inches wide. It is provided with E-shaped raised domains. The walls forming the outline of the domains are 1 millimeter high, and are perpendicular to the surface of the chill roll. The chill roll is rotated at a speed of about 700 rpm, corresponding to a linear velocity of the peripheral surface of the chill roll of about 895 meters per minute. A nozzle having a slotted orifice of 0.9 millimeter width and 51 millimeter length defined by a first lip of 1.8 millimeter width and a second lip of 2.4 millimeter width (lips numbered in direction of rotation of the chill roll) is mounted perpendicular to the direction of movement of the peripheral surface of the chill roll, such that the gap between the second lip and the surface of the chill roll is 0.05 millimeter, and the gap between the first lip and the surface of the chill roll is 0.06 millimeter. Metal having composition $Fe_{40}Ni_{40}P_{14}B_6$ (atomic percent) with a melting point of about 950° C. is employed. It is supplied to the nozzle from a pressurized crucible wherein it is maintained under pressure of about 0.7 psig at temperature of 1000° C. Pressure is supplied by means of an argon blanket. The molten metal is expelled through the slotted orifice at the rate of 14 kilograms per minute. It solidifies on the surface of the chill roll into E-shaped section of 0.05 millimeter thickness having the outline of the raised domains, and a continuous strip of scrap out of which the E-shaped sections have been "punched out." Upon examination using X-ray diffractometry, the E-shaped sections are found to be glassy (amorphous) in structure.

Since various changes and modifications may be made in the invention without departing from the spirit and essential characteristics thereof, it is intended that all matter contained in the above description be interpreted as illustrative only, being limited by only the scope of the appended claims.

I claim:

1. Apparatus for making essentially flat metal sheets having predetermined defined outline directly from the melt comprising, in combination:

(a) a movable chill body providing a chill surface for deposition thereon of molten metal for solidification, said chill body being adapted to provide longitudinal movement of said chill surface at velocity of from about 100 to about 2000 meters per minute, said chill surface being provided with essentially flat raised and/or lowered domains having the outline of the desired shape of the shaped metal sheet product, said domains being defined by a bordering wall having a height of at least about 0.02 millimeter, said bordering wall being formed at an angle deviating not more than about 20° from the normal to the chill surface;

(b) a reservoir for holding molten metal; in communication with (c) a slotted nozzle for depositing molten metal onto said chill surface, located in close proximity to said chill surface, having its slot arranged generally perpendicular to the direction of movement of the chill surface, said slot being defined by a pair of generally parallel lips, a first lip and a second lip numbered in direction of movement of the chill surface, wherein said slot has a width of from about 0.2 to about 1 millimeter, measured in direction of movement of the chill surface, wherein said first lip has a width at least equal to the width of said slot, and said second lip has a width of from about 1.5 to about 3 times the width of said slot, wherein the gap between the lips and the surface of the domains on the chill surface is from about 0.1 to about 1 times the width of said slot; and (d) means for effecting expulsion of the molten metal contained in said reservoir through said nozzle for deposition onto the moving chill surface.

2. Apparatus according to claim 1 wherein the movable chill body is adapted to provide longitudinal movement of the chill surface at a velocity of from about 650 to about 1500 meters per minute; wherein the first lip has a width of from about 1.5 to about 3 times the width of the slot; and wherein the second lip has a width of from about 2 to about 2.5 times the width of the slot.

3. Apparatus according to claim 1 wherein the bordering walls defining the outlines of the domains have a height of at least about 0.05 millimeter.

4. Apparatus according to claim 3 wherein the slot has a width of from about 0.6 to about 0.9 millimeter.

5. Apparatus according to claim 3 wherein the movable chill body is an annular chill roll having raised domains.

6. Apparatus according to claim 5 wherein the chill roll is adapted to provide longitudinal movement of the chill surface of from about 300 to about 1500 meters per minute; wherein the first lip has a width of from about 1.5 to about 3 times the width of the slot; and wherein the second lip has a width of from about 2 to about 2.5 times the width of the slot.

7. Apparatus according to claim 3 wherein the chill body comprises an endless belt having raised domains.

8. The method of making essentially flat metal sheets having predetermined defined outline directly from molten metal comprising:

a forcing the molten metal under pressure through a slotted nozzle located in close proximity to a chill surface which is provided with raised and/or lowered essentially flat domains having the outline of the desired shape of the shaped metal sheet product, said domains being defined by a bordering wall having a height of at least about 0.02 millimeter, said bordering wall being formed at an angle deviating not more than about 20° from the normal to the chill surface and said nozzle having its slot arranged generally perpendicular to the direction of movement of the chill surface.

b. advancing the chill surface, at a predetermined speed; and c. quenching the molten metal in contact with the chill surface to permit the metal to solidify on the chill surface to form the essentially flat metal sheets having an outline corresponding to that of the bordering walls of said domains.

9. The method of claim 8 wherein the chill surface is advanced relative to said nozzle at a velocity of from about 200 to about 2000 meters per minute.

10. The method of claim 9 wherein said nozzle is defined by a pair of generally parallel lips located in close proximity to the chill surface to provide a gap between nozzle and chill surface of from about 0.03 to about 1 millimeter.

11. The method according to claim 10 wherein molten alloy is forced onto a moving chill body surface provided with domains defined by a bordering wall having a height of at least about 0.05 millimeter.

12. The method according to claim 11 wherein the chill body surface is provided with raised domains.

13. The method according to claim 12 wherein the molten metal is an alloy which upon cooling from the melt and quenching at a rate of at least about $10^{4°}$ C./sec. forms an amorphous solid.

14. The method according to claim 12 wherein the molten metal is forced through a nozzle having a width of from about 0.3 to about 1 millimeter, measured in direction of movement of the chill body.

15. The method of claim 12 conducted under vacuum of from about 100 to about 3000 microns.

* * * * *